US007855513B2

(12) United States Patent
Malik et al.

(10) Patent No.: US 7,855,513 B2
(45) **Date of Patent: *Dec. 21, 2010**

(54) DEVICE AND METHOD FOR GAS TREATMENT USING PULSED CORONA DISCHARGES

(75) Inventors: Muhammed Arif Malik, Norfolk, VA (US); Karl H. Schoenbach, Norfolk, VA (US)

(73) Assignee: Old Dominion University Research Foundation, Norfolk, VA (US)

( * ) Notice: Subject to any disclaimer, the term of this patent is extended or adjusted under 35 U.S.C. 154(b) by 464 days.

This patent is subject to a terminal disclaimer.

(21) Appl. No.: 11/868,371

(22) Filed: Oct. 5, 2007

(65) Prior Publication Data

US 2008/0023317 A1 Jan. 31, 2008

Related U.S. Application Data

(63) Continuation-in-part of application No. 11/238,072, filed on Sep. 28, 2005, now Pat. No. 7,298,092.

(60) Provisional application No. 60/613,794, filed on Sep. 28, 2004.

(51) Int. Cl.
*H01J 7/24* (2006.01)

(52) U.S. Cl. ..... 315/111.91; 315/111.71; 204/164

(58) Field of Classification Search ..... 315/111.01–111.91; 118/723 R, 723 E; 204/164; 156/345.45, 345.46, 345.47
See application file for complete search history.

(56) References Cited

U.S. PATENT DOCUMENTS 4,178,877 A 12/1979 Kudo
4,812,711 A * 3/1989 Torok et al. ..... 315/111.91
5,336,326 A 8/1994 Karner et al.
5,387,842 A * 2/1995 Roth et al. ..... 315/111.21
5,655,210 A * 8/1997 Gregoire et al. ..... 422/186
5,753,886 A * 5/1998 Iwamura et al. ..... 219/121.43
5,866,081 A 2/1999 Williamson et al.
5,904,905 A 5/1999 Dolezal et al.
5,968,377 A * 10/1999 Yuasa et al. ..... 219/121.41
6,321,531 B1 11/2001 Caren et al.
6,441,553 B1 * 8/2002 Yializis et al. ..... 315/111.21
6,465,964 B1 10/2002 Taguchi et al.
6,774,335 B2 * 8/2004 Yanobe et al. ..... 219/121.43

(Continued)

OTHER PUBLICATIONS

Kashiwagi, et al., "Synchronization of Positive Surface Streamers Triggered by Vacuum Ultraviolet in Atmosphere", Journal of Physics D: Applied Physics, 2006 pp. 113-118.

*Primary Examiner*—Douglas W Owens
*Assistant Examiner*—Tung X Le
(74) *Attorney, Agent, or Firm*—Novak Druce + Quigg LLP; Gregory A. Nelson; Eduardo J. Quinones

(57) ABSTRACT

A plasma reactor is provided, which includes a discharge chamber with dimensional characteristics and configuration of dielectric and electrodes so as to enhance efficiency based on the characteristics of the corona discharge streamers generated. Upon application of a pulsed high voltage potential, the discharge chamber enables formation of plasma where surface streamers play a greater role in the overall energy density of the discharge chamber than gas streamers. The formation of gas streamers is constrained. Because surface streamers have a higher energy density, the present invention is able to achieve improved energy efficiency while preserving effectiveness for gas treatment.

8 Claims, 5 Drawing Sheets

U.S. PATENT DOCUMENTS

| | | | | |
|---|---|---|---|---|
| 6,835,358 | B2 | 12/2004 | Hemingway et al. | |
| 7,074,370 | B2 | 7/2006 | Segal et al. | |
| 7,652,431 | B2 * | 1/2010 | Krichtafovitch | 315/111.91 |
| 2002/0129902 | A1 | 9/2002 | Babayan et al. | |
| 2003/0012718 | A1 | 1/2003 | Josephson et al. | |
| 2003/0150709 | A1 | 8/2003 | LaBarge et al. | |
| 2005/0093458 | A1 | 5/2005 | Babayan et al. | |
| 2006/0153750 | A1 | 7/2006 | Miyairi et al. | |

* cited by examiner

DEVICE AND METHOD FOR GAS TREATMENT USING PULSED CORONA DISCHARGES

CROSS REFERENCE TO RELATED APPLICATION

The present application is a Continuation in Part of application Ser. No. 11/238,072, filed Sep. 28, 2005, now issued U.S. Pat. No. 7,298,092, which claims priority from U.S. Provisional Application Ser. No. 60/613,794 filed Sep. 28, 2004.

BACKGROUND OF THE INVENTION

1. Field of the Invention

The present invention relates to devices and methods for chemical processing. More specifically, the present invention relates to an energy efficient device for the treatment of a gas including the decomposition of chemical compounds within a gas, such as the abatement of pollution within an exhaust gas by the use of an efficient corona discharge plasma reactor.

2. Background

A variety of methods have been investigated for processing chemicals within gases, such as the removal of volatile organic compounds (VOCs) from exhaust gases. One area of study has been the use of electrical discharges within the gas that are designed to interact with the chemicals of concern.

A subset of this field involves the use of corona discharges. A corona or corona discharge is a current discharge between two electrodes with a potential gradient sufficiently high so as to ionize a neutral fluid or gas, creating plasma within the fluid about the electrodes. This plasma state enables the fluid to conduct a charge, even when under other conditions the fluid might be non-conductive.

If one of the electrodes forms a sharp edge or point, then the surrounding fluid will face a higher potential gradient at that area, which can localize plasma formation for a particular applied energy. This feature creates a defined area of conductivity about the edge or point, which can be conductive while other areas in the gas are not. Without such a defined electrode, the potential gradient may not be as high and greater energy may be required for plasma formation. Thus, a corona discharge usually involves two differently shaped electrodes. One electrode may be a needle, a sharp edge, or wire extending in an axial direction. The other electrode may provide a surface proximate to the other electrode, such as a plate or cylinder. Thus, the sharp or defining edge of an electrode can enhance the potential gradient, depending on the application.

Pulsed corona discharges have been used to treat gases, such as the destruction of VOCs. One example of an electrode structure used in VOC abatement is a coaxial geometry, with the center electrode being a wire extending in an axial direction surrounded by a tubular outer electrode. Typically, a dielectric or insulating terminal at each end separates the electrodes and maintains a desired gap or distance. The gas flows along the axis within the tube around the inner electrode. Short high voltage electrical pulses with a fast voltage rise may be applied across the discharge gap between the electrodes. As these pulses are applied across the electrodes a non-homogeneous electric field is created and multiple thin plasma channels or streamers may arise, depending on a number of factors including the type of gas and the pressure. These streamers may arise both in the gas between the electrodes and along the surface of the dielectrics. The pulse duration may be limited to prevent arcing between the electrodes. If a positive charge is placed on the center electrode then the streamer generated will be positive, and will travel from the center electrode or anode to the tubular outer electrode or cathode, forming a positive corona. Other electrode configurations include point-plane, wire-plane, or wire-cylinder. The electrodes are located within a gas discharge chamber also referred to as a plasma reactor. The configurations of such devices may vary, depending on the configuration of the electrodes and the application.

Within the discharge chamber, the plasma ionization produces reactive species, such as radicals or ions and electrons. Positive species will be attracted to a negative electrode while electrons will be attracted in the opposite direction, to a positive electrode. In some cases, a physical configuration or electric field may prevent the recombination of an electron and positive species, preserving it for another purpose. Recombination may be permitted beyond the region of ionization, so that the ionized particles are then attracted to oppositely charged particles or surfaces and recombine. The electric field may accelerate or impart energy to the electrons or radicals within a gas streamer. The high-energy particles can be used to interact with a chemical or pollutant within the gas. For example, a high energy electron may collide with chemical molecule and induce decomposing chemical reactions to produce inert or less toxic chemicals as the gas flows along the discharge chamber.

Effective decomposition of a chemical or pollutant using corona discharges typically requires significant energy consumption. The energy applied across the electrodes is a major contributor to the energy density of the plasma and the population of radical species produced by such devices. In general, the greater the quantity of radical species produced, the greater the likelihood of radical interaction with the contaminant or chemical. Therefore, a technology that increased the efficiency pf corona discharge devices would decrease their operating costs and expand the field of application.

BRIEF SUMMARY OF THE INVENTION

The present invention is a device and method for using pulsed corona discharges to interact with chemicals in a gas, including the decomposition of volatile organic compounds in an exhaust gas, with an improved efficiency based on the type of corona streamers.

Thus, an object of the present invention is to provide a device for the effective treatment of a gas using a pulsed corona discharge while consuming less energy than conventional processing and treatment methods.

To achieve this object, the present invention introduces a novel plasma reactor with a discharge chamber having dimensional characteristics and configuration of dielectric and electrodes that optimizes efficiency based on the characteristics of the streamers generated. As mentioned above, in most plasma reactors, streamers may be produced both within the gas between the electrodes and along the surface of the dielectric or insulation separating the electrodes. For convenience, these two types of streamers may be referred to as "gas streamers" and "surface streamers." Conventional devices have focused primarily on plasma reactor discharge chambers in which gas streamers dominate the overall energy density within the discharge chamber.

The present invention involves a discharge chamber with plasma where surface streamers play a greater role than in the overall energy density of the discharge chamber. In other words, the present invention achieves greater energy efficiency over conventional designs, while preserving effectiveness for chemical treatment, because the production of gas streamers is constrained and surface streamers play a greater role in the overall energy density. The effect of increasing the role surface streamers may be achieved in a variety of ways, depending on the configuration of the electrodes, the dielectric, and the discharge chamber. For example, in the coaxial configuration discussed above, the typical dielectric end fittings or terminals may be brought together into close proximity, reducing the axial distance of the electrodes and the volume of the discharge chamber. That is, the axial length of the electrodes may be reduced relative to the dimensions of the dielectric, while maintaining the orthogonal and other dimensions. The dielectric then constrains the formation of gas streamers but permits the formation of surface streamers. In an alternative embodiment, the gas may be applied orthogonally across a wire electrode and a plurality of dielectrics may be employed to create narrow orthogonal channels as the discharge chamber, as further described herein. The narrowness of the discharge chamber can constrain the formation of gas streamers. Other dimensional changes may be made to achieve the same effect for electrodes and dielectrics having different configurations, whether point-plane, point-wire, etc. In general, the effective length or distance will be that at which the formation of gas streamers is constrained for the gas and corona discharge, as described in greater detail below.

The dimensional changes should effectively increase the proportion of surface streamers to gas streamers within the discharge chamber. This has two results. First, in the present invention, the energy density attributable to surface streamers within the boundary layer of gas near the dielectric plays a relatively larger role in the overall energy density, producing an overall increase in energy density within the discharge chamber. For a given input energy, surface streamers are characterized by a greater relative photoelectron emission of high energy electrons, and thus produce more reactive ionic species, enhancing chemical interaction. These chemical reactions include decomposition of VOCs (as designated by RH) to acceptable products, as shown in reaction equations (1) through (3.2):

$$O_2+e^-\rightarrow O_2+e^- \quad (1)$$

$$O_2+RH\rightarrow O_2 \quad (2.1)$$

$$O_2+RH\rightarrow \text{Products} \quad (2.2)$$

$$RH^++e^-\rightarrow RH\rightarrow R+H \quad (3.1)$$

$$RH^++e^-\rightarrow \text{Products} \quad (3.2)$$

Second, in conventional reactors, surface streamers are limited to low flow areas. In the present invention, surface streamers lie within the dynamic flow region of the gas, enabling them to interact more effectively with entrained chemicals or pollutants. This aspect, coupled with an energy distribution having a greater population of high energy electrons, leads to improved efficiency over conventional devices.

Thus, if the present invention is used to treat an exhaust gas in order to abate a chemical within the gas, then the chemicals of concern will be exposed to corona discharges in which surface streamers dominate. For a given energy level, the chemicals are more likely to be decomposed by this plasma because of the greater density of high-energy electrons over a conventional reactor.

Those skilled in the art will appreciate that the present invention may be used with conventional abatement methods, exhaust gas treatment, decontamination, odor control, or other discharge energy reduction technologies, and in such configurations as may be appropriate for the application.

ELEMENT LIST

| ELEMENT LIST | |
|---|---|
| 10 | Reactor |
| 11 | Gas Inlet |
| 12 | Gas Outlet |
| 15 | Discharge chamber |
| 17 | High voltage electrode |
| 18 | Counter electrode |
| 19 | Dielectric |
| 30 | Gas flow direction arrow |
| 50 | High voltage power supply |
| 51 | Trigger generator |
| 52 | Spark gap switch |
| 53 | Ground |
| 54 | Voltage divider |
| 55 | Resistor |
| 56 | Capacitor |
| 57 | High voltage electrode terminal |
| 58 | Counter electrode terminal |
| 60 | Oscilloscope |

DETAILED DESCRIPTION

The following detailed description is not to be taken in a limiting sense, but is made merely for the purpose of illustrating general principles of embodiments of the invention.

As introduced above, the present invention is an energy efficient corona discharge reactor in which the formation of gas streamers is constrained by the configuration of the dielectrics and electrodes, increasing the role of surface streamers in overall energy density.

Figure 1:
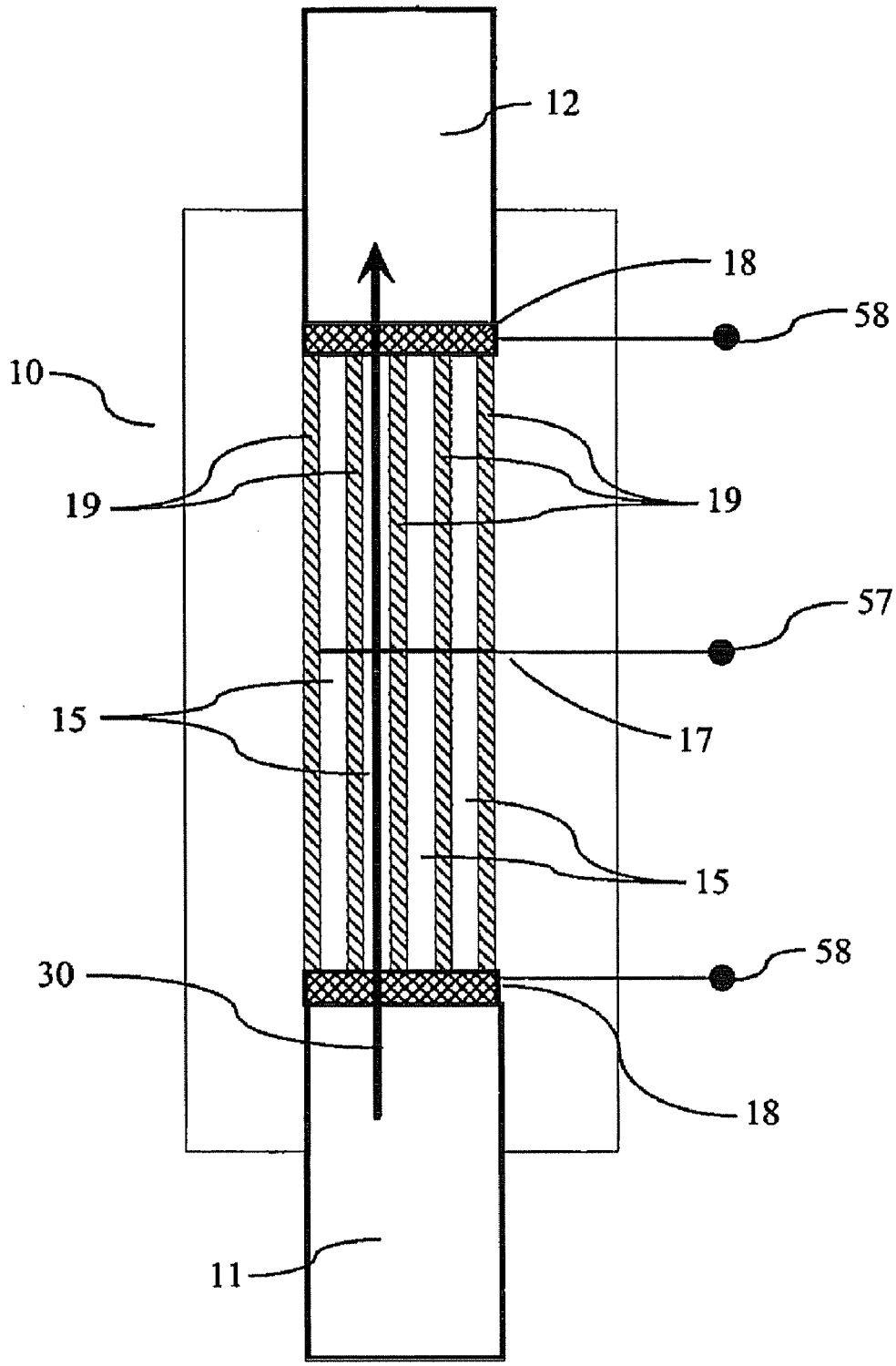
FIG. 1 shows a sample embodiment of the invention.

With reference to the drawings, a schematic example of the present invention is shown in FIG. 1. In this simple embodiment of reactor 10 a high voltage pulse is applied to one or more high voltage electrodes 17. Use of a pulse prevents arcing. In this case, high voltage electrode 17 is a wire inserted across four discharge chambers 15, which also serve as gas channels formed by five dielectrics 19. High voltage electrode 17 may also be a threaded rod, sharp edge, or any other localizing configuration of electrode capable of producing streamers, as is known to those in the field and may be appropriate for the application. Of course, the number of discharge chambers 15 shown is for illustration purposes, a reactor may be formed with more or fewer of such channels, depending on the application. Counter electrode 18 is shown in the form of a wire mesh for this embodiment, but it may also be a cylinder, plate, wire, or other conductive electrode configuration known in the art. For a configuration such as this, counter electrode 18 permits the flow of gas into and out of gas discharge chambers 15. Thus, gas flows in the direction of arrow 30 from gas inlet 11 into reactor 10 along discharge chambers 15 and, after treatment, exits by gas outlet 12. In this configuration the effective distance for the formation of gas streamers by electrodes 17 and 18 is the narrow or limited width of the discharge chamber 15, which is defined by dielectrics 19.

Figure 2:
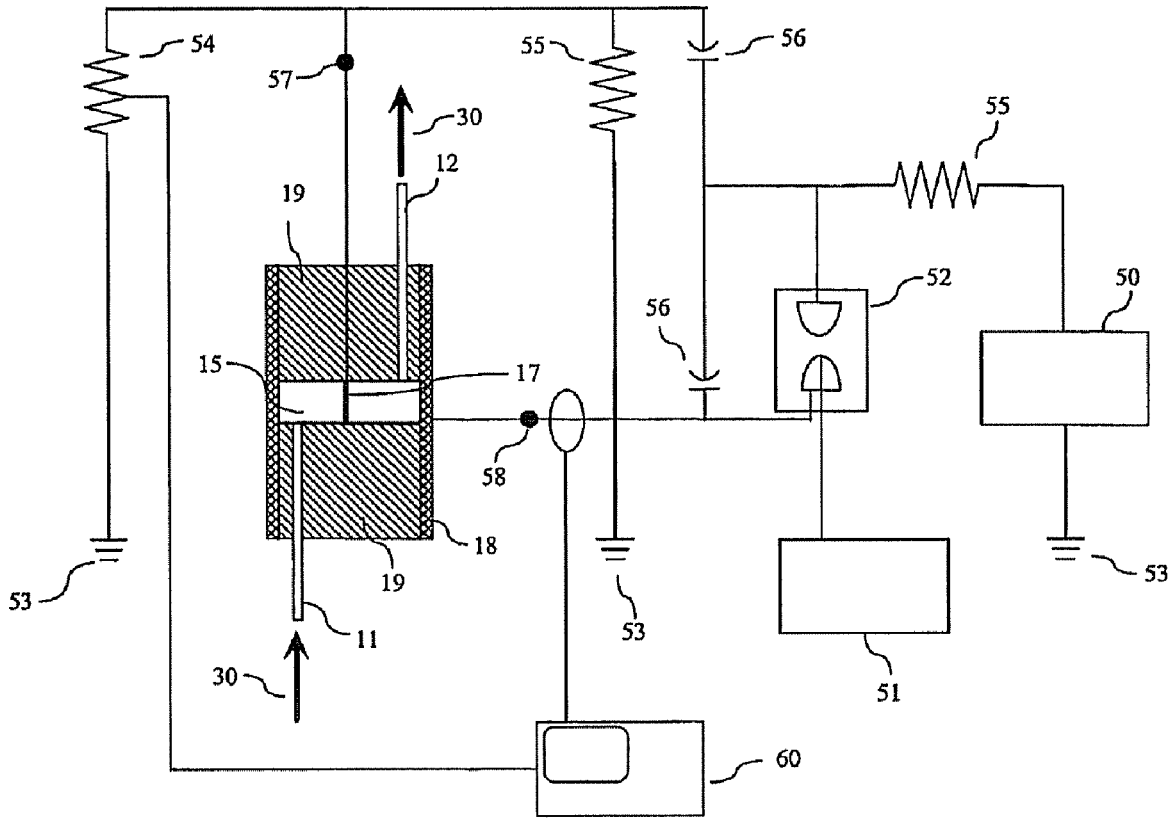
FIG. 2 is an experimental embodiment of the invention.

Another embodiment is demonstrated in FIG. 2, illustrating a different configuration of reactor 10 that includes an example of the supporting electrical circuitry. In this version, reactor 10 includes discharge chamber 15 surrounded radially by counter electrode 18, which is simply a conductive pipe or hollow aluminum cylinder. High voltage electrode 17 is a tungsten wire coaxially inserted within discharge chamber 15. Dielectrics 19 are plugs or end fittings inserted into the openings of counter electrode 18. Dielectrics 19 may be fabricated from any of a variety of insulating material, such as polymethylmethacrylate, depending on the application. The length of electrodes 17 and 18 is the same as the distance between dielectrics 19, which is the effective length for formation of gas streamers. For testing purposes, dielectrics 19 may be positioned at different points axially within counter electrode 18 in order to vary the distance separating them. At the same time, repositioning dielectrics 19 varies the size of discharge chamber 15 and the respective distance or length of high voltage electrode 17 within discharge chamber 15. Gas inlet 11 and gas outlet 12 enable a gas to be applied through discharge chamber 15.

In test operation of the embodiment of FIG. 2, a high voltage pulse may be formed using an L-C inversion circuit, with trigger generator 51, spark gap switch 52, capacitors 56, and high voltage direct current power supply 50. This pulse was applied to high voltage electrode 17, while counter electrode 18 was grounded. A sample pulse was achieved having a rise time of 70 ns, voltage amplitude of 28 kV, and a voltage decay time 4.5 ms. The pulse duration preferably is short enough to prevent the occurrence of a transition from streamer to arc. Those skilled in the art will readily see that a variety of circuits may be used and pulses having different characteristics may readily be achieved. A sample test feed gas of dry air contaminated with 300 ppm hexane or toluene as chemicals of concern was applied across reactor 10 via gas inlet 11. The decomposition of the chemical of concern was measured by a gas chromatograph (not shown) to determine the Destruction and Removal Efficiency (DRE), which is the mole percentage of the compound removed with respect to the initial amount. Specific energy input, being the energy per unit volume of treated gas, was determined by a time integrated product of current and voltage. As a baseline for comparison, an electrode length of 900 mm has been shown to have a 90% DRE. R. A. Korzekwa, et al., "Destruction of hazardous air pollutants using a fast rise time pulsed corona reactor" Review of Scientific Instruments, Vol. 69: 1886-1891 (April 1998.)

Figure 3:
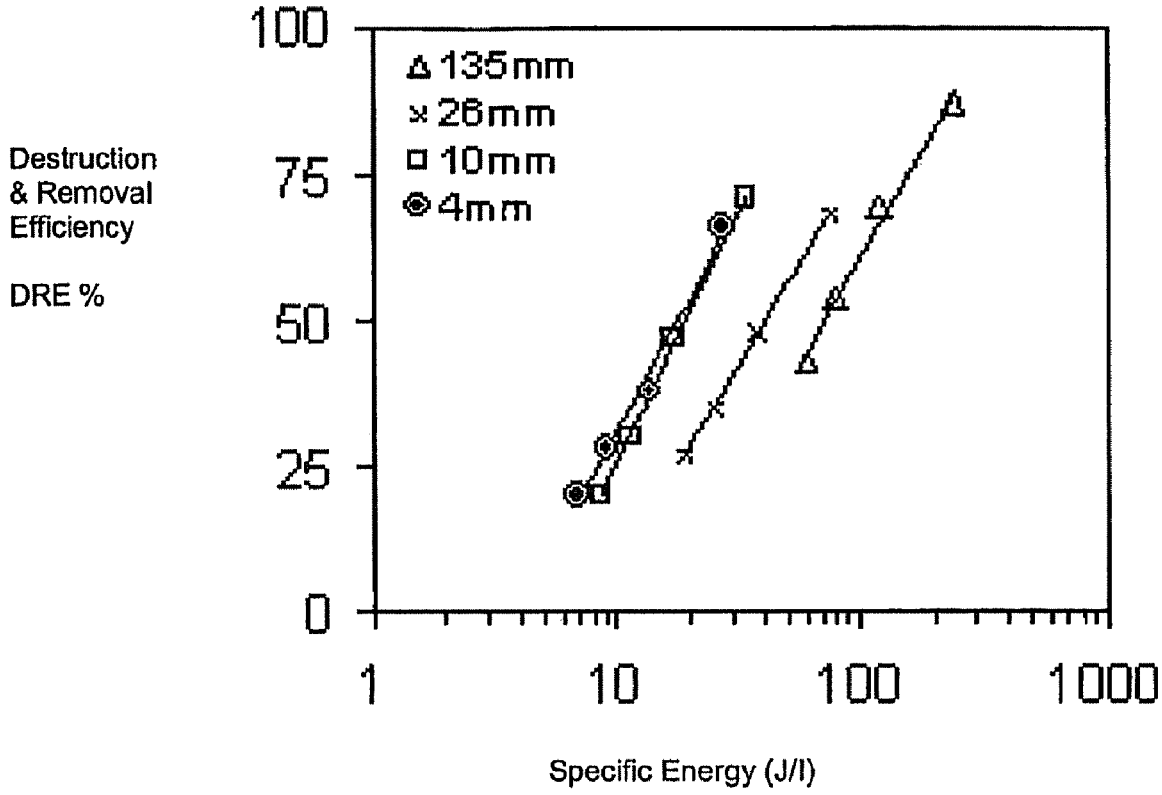
FIG. 3 is a graph of the energy (E) per pulse verse electrode length (solid line) and energy density (dE/dl) verse electrode length (dashed line) curves.

Using the embodiment in FIG. 2, the effective length or the axial distance of high voltage electrode 17 and the portion of counter electrode 18 exposed within discharge chamber 15 (i.e., being the same as the distance between dielectrics 19 for this example) was changed to 135 mm, 26 mm, 10 mm, and 4 mm by moving dielectrics 19. In these variations, other dimensions of the geometry of reactor 10, such as the radius of counter electrode 18, were kept the same. For a consistent voltage, the current and the energy per pulse required for effective decomposition decreased as the effective length available for the formation of surface streamers was reduced. FIG. 3 shows the energy input or consumed over the change in effective length, here the same as electrode length. As may be seen, energy density at short lengths was high due to the relatively large role of surface streamers; at longer distances (i.e., beyond 10 mm for this gas and configuration) the surface streamers play less of a role, gas streamers play a greater role, and energy density decreased to a constant of about 4.5 mJ/mm.

Thus, for a distance of 135 mm distance, gas streamers would be expected to dominate the plasma within discharge chamber 15. For a distance of 4 mm or 10 mm, the effect of surface streamers would be expected to predominate. Results with the embodiment of FIG. 2 showed a consistent DRE with decreasing energy consumption as the effective length (and both the length of high voltage electrode 17 and the distance between dielectrics 19) was reduced:

TABLE 1

| Effective length as measured by Electrode length (mm) | Input chemical concentration (ppm) | DRE (%) (Toluene destruction) | Specify energy (J/l) | Notes: |
|---|---|---|---|---|
| 900 | 330 | 90 | 120 | Korzekwa et al. |
| 135 | 300 | 89 | 122 | present invention |
| 10 | 300 | 89 | 17 | present invention |

Figure 4:
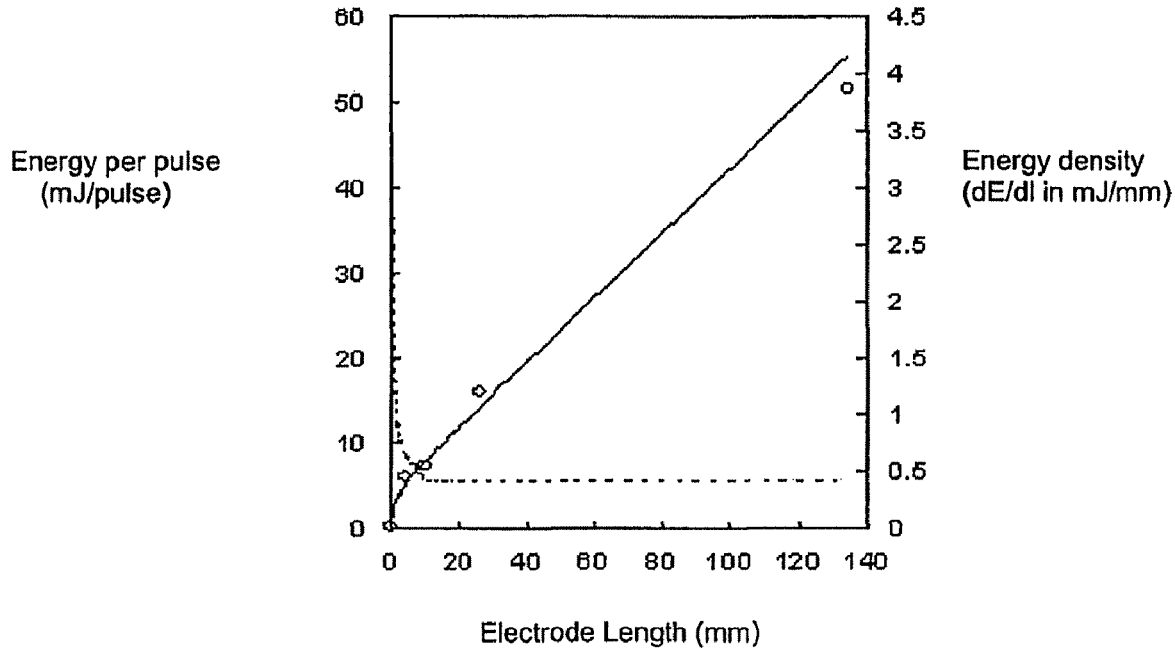
FIG. 4 is a graph of the destruction and removal efficiency (DRE) verse specific energy curves for 300 ppm hexane in dry air for different electrode lengths.
Figure 5:
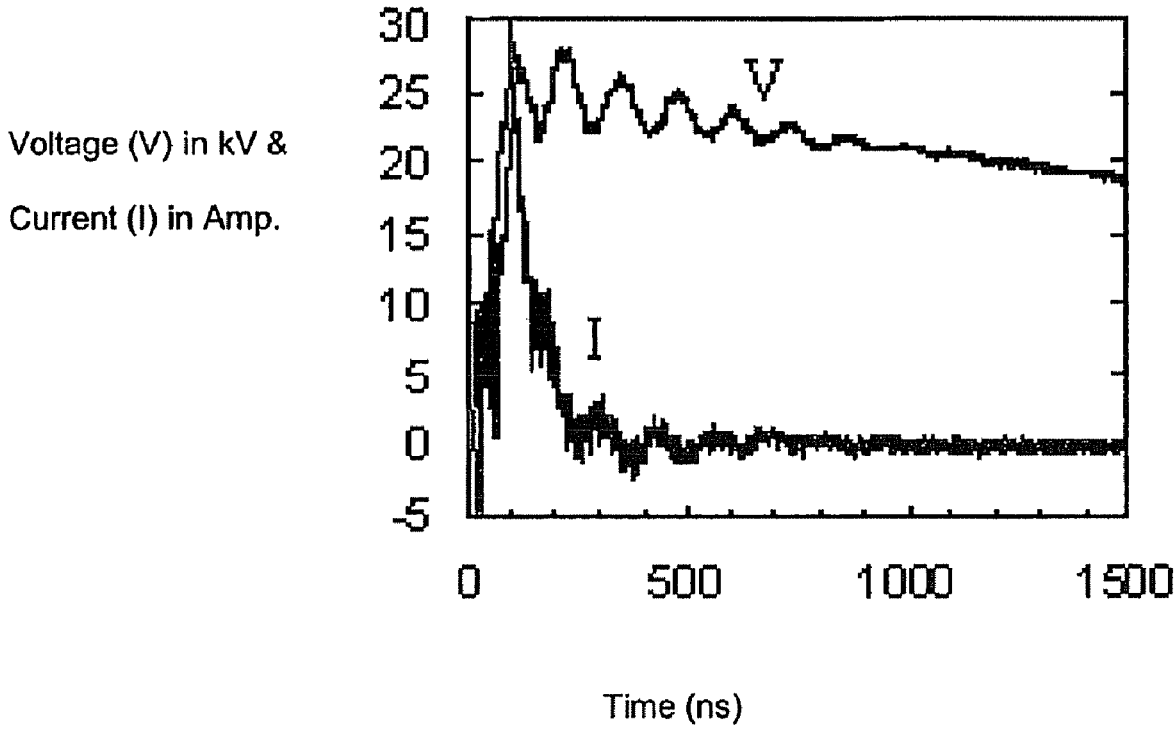
FIG. 5 is a plot of a current (I) and voltage (V) waveform for a sample pulse voltage.

As shown in Table 1, the test using the embodiment of FIG. 2 confirmed the baseline performance of Korzekwa et al. for a DRE of approximately 90% for energy consumption of approximately 122 J/l, regardless of whether the effective length was 900 mm or 135 mm. For these lengths, gas streamers dominate. However, an effective length of 10 mm decreased the energy consumption by seven times while preserving a DRE of approximately 90%. FIG. 4 is a plot of the DRE verse specific energy for a variety of effective electrode lengths. The shorter lengths of 10 mm or under (e.g., 4 mm, as shown) generally consume less energy than the lengths of 25 mm and 135 for a given DRE. Thus, preferably an application identical to the embodiment in FIG. 2, and as described in reference to FIG. 2, would have an effective length of 10 mm or less. Other embodiments of the present invention, and other operating conditions, may involve different effective lengths where surface streamers play a greater role in overall energy density than gas streamers.

Those skilled in the art will recognize that the configuration of the discharge chamber, the gas, and the associated physical conditions of the application will vary the effective length at which the formation of gas streamers is effectively constrained so that surface streamers play an increasing role in energy density. As seen in the embodiment of FIG. 1, one or more dielectrics 19 may be used to reduce the dimensions of discharge chamber 15 so as to constrain the formation of gas streamers, given that electrode configuration. In the coaxial embodiment of FIG. 2, a distance of 10 mm between dielectrics 19 was shown to be effective to begin to constrain the formation gas streamers. Smaller distances are preferable in that they increase the role of surface streamers with a corresponding increase in energy density.

More generally, the narrow or limited width of a discharge chamber, according to the invention, is less than the length of the discharge chamber. Preferably, the width of the discharge chamber is equal to one-half or less of the length. For example, with reference to FIG. 1, the width between dielectrics 19 is preferably one-half or less the length of the discharge chamber 15, defined by dielectrics 19.

The present invention includes the method of treating a gas in a plasma reactor discharge chamber using the above principles. This method involves the steps of applying the gas to a discharge chamber, in which is generated a pulsed corona discharge where the formation of gas streamers is inhibited, so that surface streamers play an increasing role in energy density within the discharge chamber.

Accordingly, the present invention is a device and method for the treatment of a gas using a plasma reactor capable of generating a corona discharge where surface streamers play a greater role than gas streamers. The plasma of a reactor in which surface streamers play a relatively greater role in overall energy density has been shown to be more energy efficient than conventional designs, while preserving effectiveness for chemical treatment.

As noted above, those skilled in the art will recognize that such a plasma reactor may not only be used with conventional gas treatment, but also for decontamination, odor control, etc. While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A plasma reactor for the treatment of a gas, comprising:

a gas inlet for receiving the gas prior to treatment;

a discharge chamber connected to the gas inlet and having a first electrode, a second electrode, and a dielectric positioned adjacent to the first and second electrodes, wherein the discharge chamber is adapted to receive the gas from the gas inlet;

a circuit in electrical communication with the discharge chamber for creating a pulsed electrical potential between the first electrode and the second electrode at a voltage and current capable of producing a corona discharge having surface streamers and gas streamers; and a gas outlet connected to the discharge chamber for releasing gas from the plasma reactor after treatment;

wherein surface portions of the dielectric are substantially perpendicular to the first and second electrodes such that an electric field between the first and second electrodes is substantially parallel to the surface portions;

wherein the first electrode, second electrode, and dielectric are configured such that a width of the discharge chamber is equal to one-half or less times the length of the discharge chamber so as to constrain the formation of gas streamers between the first electrode and the second electrode such that a greater portion of overall energy density within the discharge chamber is due to the surface streamers than is due to the gas streamers.

2. A plasma reactor for receiving and treating a gas, comprising:

a gas inlet for receiving the gas prior to treatment;

a discharge chamber connected to the gas inlet to receive the gas and having a first electrode, a dielectric, and a second electrode;

a circuit for creating a pulsed electrical potential between the first electrode and the second electrode at a voltage and current capable of producing corona surface streamers along a surface of the dielectric and capable of producing corona gas streamers between the first electrode and the second electrode; and a gas outlet connected to the discharge chamber for releasing gas from the plasma reactor after treatment;

wherein surface portions of the dielectric are substantially perpendicular to the first and second electrodes such that an electric field between the first and second electrodes is substantially parallel to the surface portions;

wherein the dielectric is interposed between the first and second electrodes and the first electrode, second electrode, and dielectric are configured such that a width of the discharge chamber is equal to one-half or less times the length of the discharge chamber so as to constrain the formation of gas streamers between the first electrode and the second electrode such that a greater portion of overall energy density within the discharge chamber is due to the surface streamers than is due to the gas streamers.

3. The plasma reactor according to claim 2, wherein the first electrode is a wire and the second electrode is substantially planar.

4. The plasma reactor according to claim 2, wherein the first electrode and the second electrode are in a substantially coaxial relationship.

5. The plasma reactor according to claim 2, wherein the first electrode is a wire and the second electrode is a mesh.

6. A method for the treatment of gas, comprising:

receiving the gas into a gas inlet prior to treatment feeding the gas from the gas inlet into a plasma reactor discharge chamber having a first electrode, a second electrode, and a dielectric;

applying with an electrical circuit connected to the plasma reactor discharge chamber a pulsed corona discharge across the first and second electrodes to treat the gas, wherein the corona discharge includes surface streamers and gas streamers; and releasing the gas through a gas outlet connected to the plasma reactor discharge chamber after treatment;

wherein surface portions of the dielectric are substantially perpendicular to the first and second electrodes such that an electric field between the first and second electrodes is substantially parallel to the surface portions;

wherein the plasma reactor discharge chamber is configured such that a width of the discharge chamber is equal to one-half or less times the length of the discharge chamber so as to inhibit the formation of gas streamers such that a greater portion of overall energy density within the discharge chamber is due to the surface streamers than is due to the gas streamers.

7. The method of claim 6, wherein the first electrode is a wire and the second electrode is substantially planar.

8. The method of claim 6, wherein the first electrode is a wire and the second electrode is a mesh.

* * * * *